US005490597A

United States Patent [19]

Schluger

[11] Patent Number: 5,490,597

[45] Date of Patent: Feb. 13, 1996

[54] GIFT PACKAGING AND WRAPPING ENSEMBLE

[76] Inventor: Allen Schluger, 21 W. 68th St., New York, N.Y. 10023

[21] Appl. No.: 203,308

[22] Filed: Mar. 1, 1994

[51] Int. Cl.[6] ..... B65D 71/00

[52] U.S. Cl. ..... 206/575; 229/87.19; 229/917; 229/922

[58] Field of Search ..... 206/575; 229/917, 229/921, 922, 923, 87.19

[56] References Cited

U.S. PATENT DOCUMENTS

| | | | |
|---|---|---|---|
| 4,867,372 | 9/1989 | Patterson | 229/921 |
| 5,251,759 | 10/1993 | Gannon et al. | 206/575 |

*Primary Examiner*—Jacob K. Ackun

[57] ABSTRACT

An assembled kit of materials useful in mailing a gift in which advantageous double use is made of a folded mailing box about which plastic is shrunk wrap to enclose the materials and, when unfolded, the wrapped gift is placed in the box for mailing.

1 Claim, 3 Drawing Sheets

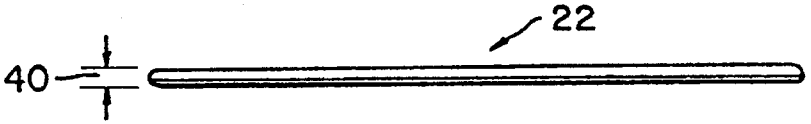
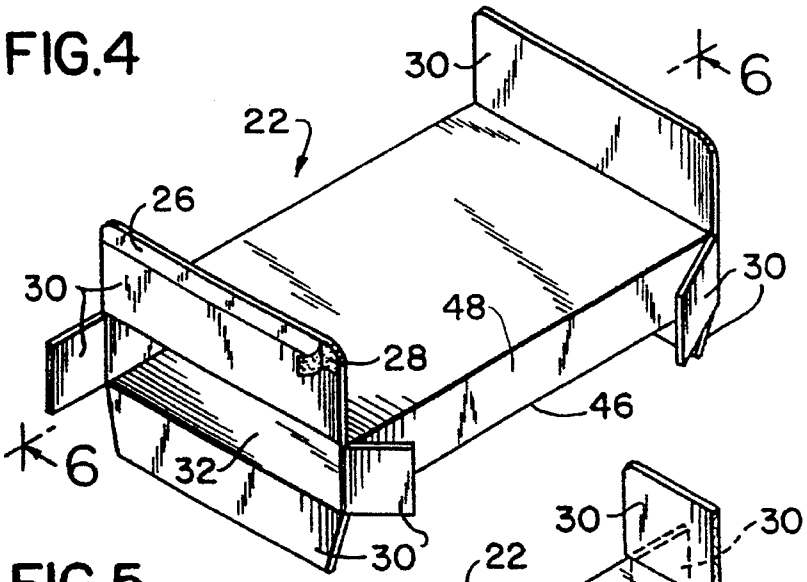
FIG.4
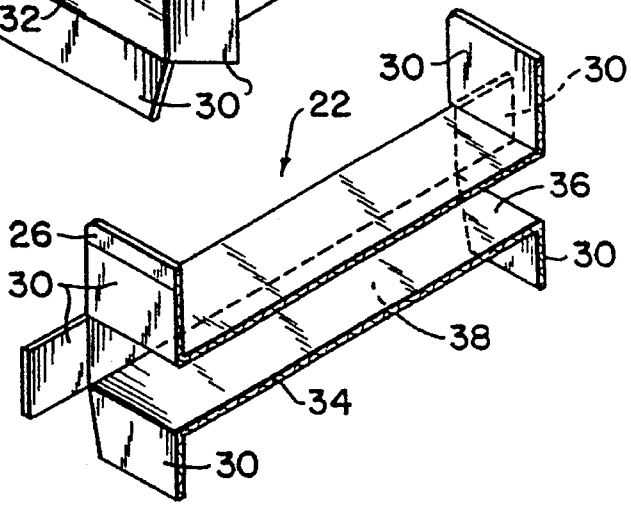
FIG.5
FIG.6
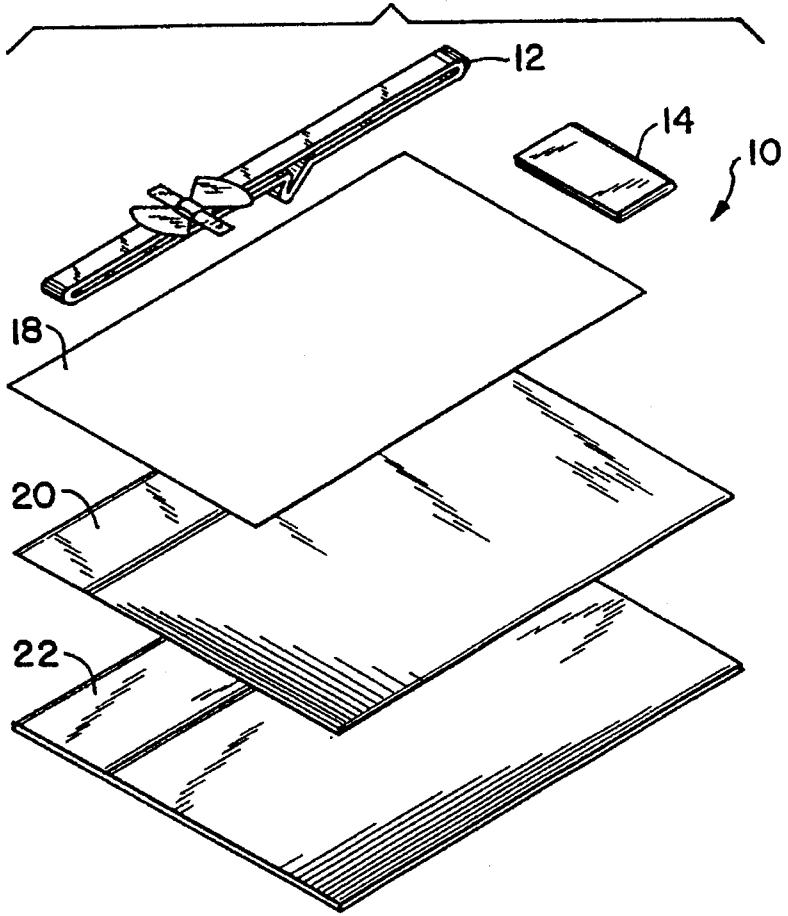
FIG.3

GIFT PACKAGING AND WRAPPING ENSEMBLE

The present invention related generally to improvements in an article of manufacture facilitating gift wrapping, in which more particularly the improvements further contribute to the utility of the article in preparing the gift for mailing.

EXAMPLE OF THE PRIOR ART

In the gift wrapping kit of U.S. Pat. No. 5,251,759 issued to Gannon et el. on Oct. 12, 1993 for "Gift Packaging and Wrapping Ensemble" the gift to be presented is enhanced for this purpose by being inserted in a gift box, wrapped in decorative paper, secured by a stretch ribbon and even accompanied by an appropriate salutation card. Although noteworthy to this point, however, the user of the kit still requires a mailing or mailer box if the mails are used to send the gift to a recipient. To obtain an appropriately sized mailer box is often time consuming and an inconvenience.

Broadly, it is an object of the present invention to provide a gift wrapping kit overcoming the foregoing and other shortcomings of the prior art. More particularly, it is an object to embody the kit in a clear plastic protective wrap suited for its sale as an article of manufacture, and to achieve this with a double functioning of a kit component allowing the use of this protective wrap and also facilitating using mail delivery to the intended recipient, all as will be better understood as the description proceeds.

The description of the invention which follows, together with the accompanying drawings, should not be construed as limiting the invention to the example shown and described, because those skilled in the art to which this invention appertains will be able to devise other forms thereof within the ambit of the appended claims.

FIG. 3 is, as noted, an exploded perspective view, but of the within inventive gift wrapping and mailing kit;

FIG. 4 is an isolated side elevational view of the mailing or mailer box component;

FIG. 5 is a perspective view of said mailer box component;

FIG. 6 is a sectional view as taken along lines 6—6 of FIG. 5;

Figure 1:
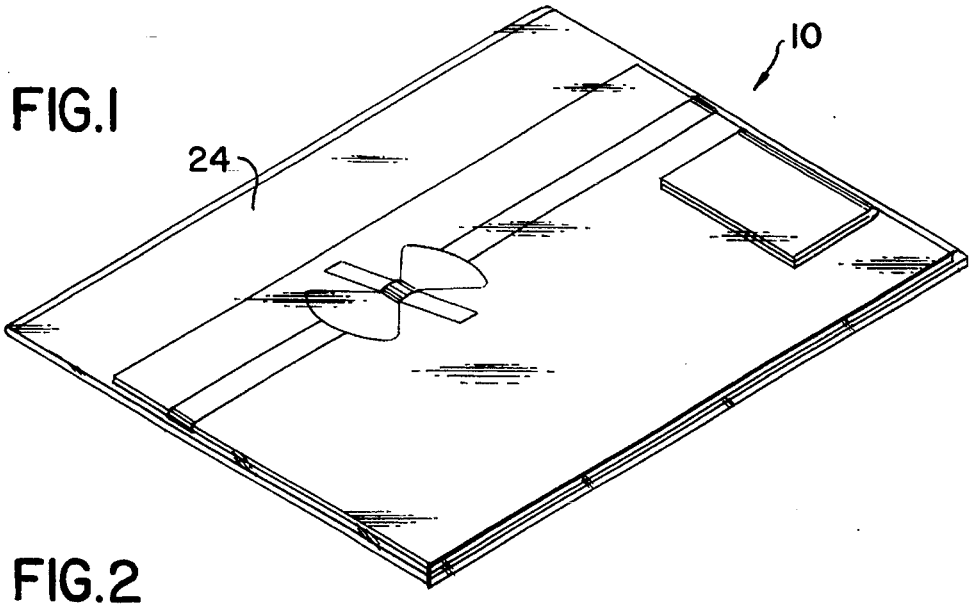
FIG. 1 is a perspective view of an assembled condition of the within inventive gift wrapping and mailing kit as presented for purchase.
Figure 2:
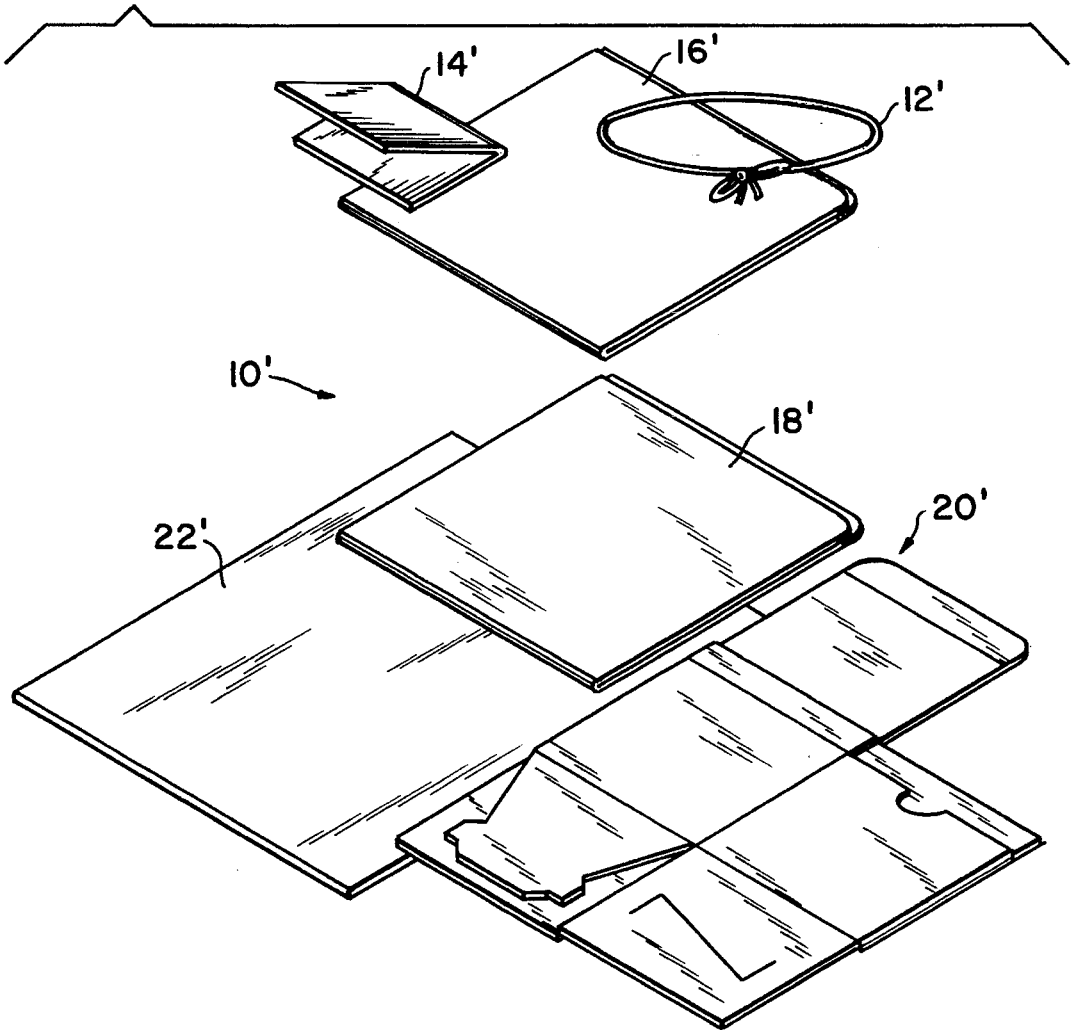
FIG.2 PRIOR ART
FIG. 2 is an exploded perspective view of a prior art similar article of manufacture provided for comparison particularly with the exploded perspective view of FIG. 3 to demonstrate the differences therebetween.

It is already well known, as exemplified by U.S. Pat. No. 5,251,759 issued to Gannon et al. on Oct. 12, 1993 for "Gift Packaging and Wrapping Emsemble" that an article of manufacture having commercial utility consists of a kit providing the necessary components for wrapping a gift preparatory to the presentation of the gift to a loved one or the like. Thus, as illustrated in FIG. 2, the referenced prior art kit, generally designated 10', includes a stretch ribbon or cord 12', a card 14', gift box wrapping paper 16', tissue paper 18', a gift box generally designated 20', and lastly a substrate or base 22' of cardboard construction material, the latter component 22' being provided to enable a plastic cover, not shown in FIG. 2 but which will be understood to be shown and designated 24 in FIG. 1, to be shrunk in a well understood manner by heat so as to form a protective closure about the kit 10' in its assembled condition. That is, the base 22' provides the rectangular shape and size to the kit 10' and, as should be well understood, is the component with the requisite firmness about which it is necessary that the outer plastic wrap 24 shrink from its initial larger size to its final diminished size in which it envelopes the components 12', 14', 16', 18' and 20', all of which are in a superposed relation on top of and within the size dimensions of the base 22'.

Although the prior art kit 10' of FIG. 2 is noteworthy, a purchaser of this kit cannot mail the gift placed within the unfolded gift box 20' because the thin cardboard construction material of the box 20' cannot withstand the normal abuse of mailing. It is thus incumbent upon the purchaser to obtain a mailing box sized to receive the gift box 20', and this often is inconvenient and time consuming.

Underlying the present invention is the recognition that the mailing box, or mailer, necessary to obviate the inconvenience noted in connection with the prior art kit 10' of FIG. 2, is of readily available cardboard construction material which will withstand the abuse of mailing and, as such, can therefore also advantageously serve as the base for the shrink-wrapping of the kit. Thus, provided as a usable component in the kit, the mailing box in its flat configuration, i.e. prior to being unfolded in a three-dimensional box, effectively replaces the prior art substrate or base 22', and, even more important, obviates the need for the purchaser of the kit to obtain an appropriately sized and structurally adequate protective box for the gift box containing the gift per se, such as a sweater, several ties, or the like.

Figure 8:
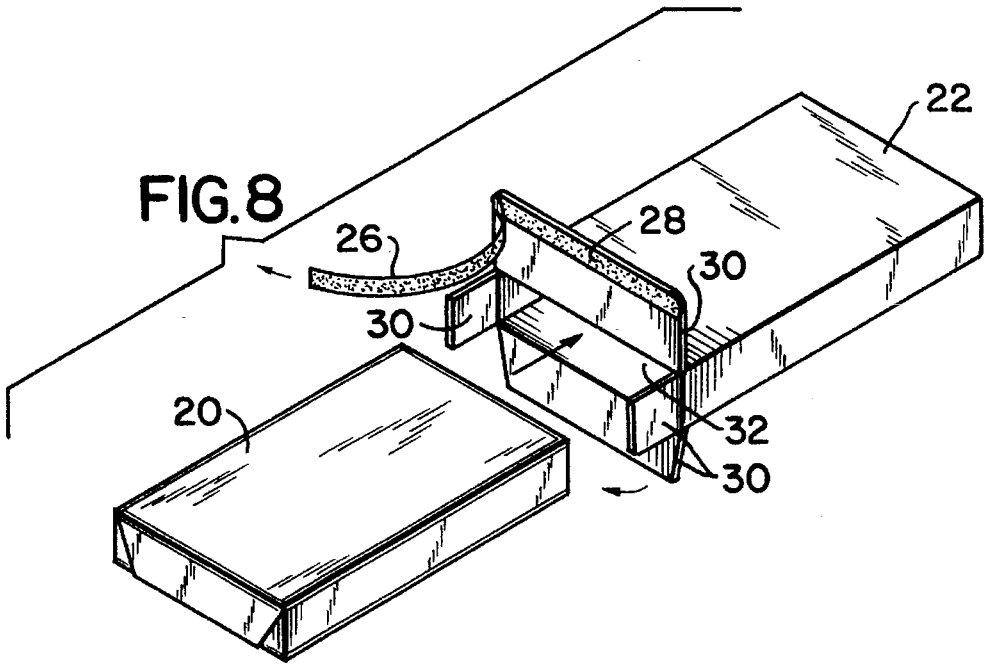
FIG. 8 is a perspective view of the unfolded mailing box component preparatory to the placement therein of the gift box component.

Referring more particularly to FIG. 3 in which the components of the within inventive kit are illustrated, it will be noted that they duplicate the components of the prior art kit 10' of FIG. 2, and are thus designated by the same but unprimed numbers. Thus, kit 10 includes a stretch ribbon 12, a salutation card 14, tissue paper 18, a gift box 20 of thin cardboard construction material and, as a replacement for the prior art substrate 22', a usable mailing box 22 sized in its unfolded condition, as best illustrated in FIG. 8, to receive therein the gift-containing box 20, after which a strip 26 is removed to expose an adhesive deposit 28 enabling in a well understood manner the folding sequence of the box flaps, individually and collectively designated 30, to form a closure for the mailing box 22 with the gift box 20 within the box compartment 32.

Figure 7:
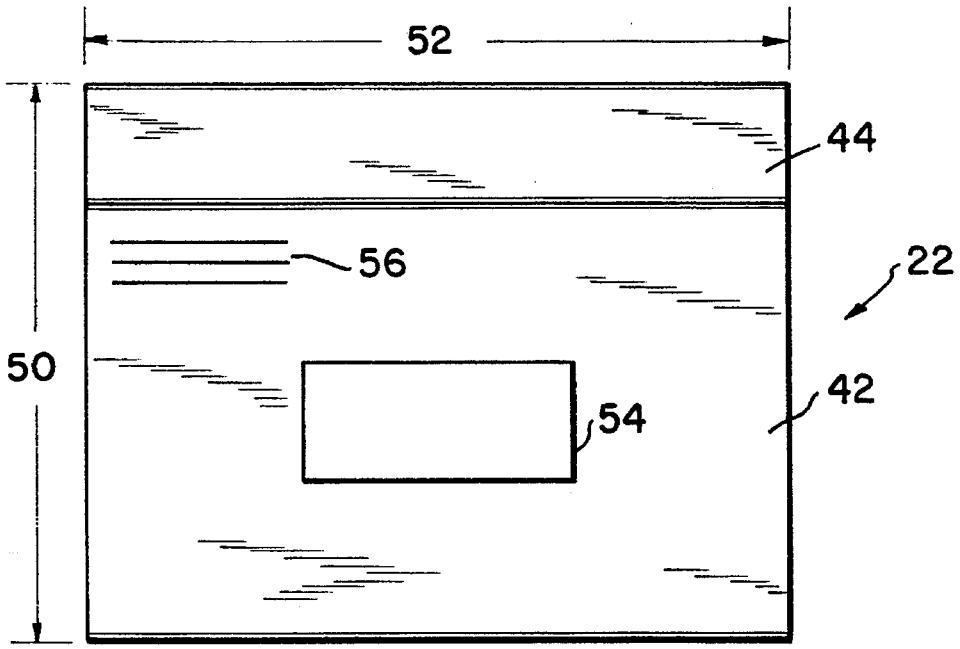
FIG. 7 is an isolated plan view of the folded mailing box component.

Further underlying the present invention is the recognition that comparatively heavy cardboard construction material selected for the embodiment of the mailer box 22, as best understood from the sectional view of FIG. 6, is of a well known construction comprised of an internal flute 34 sandwiched between plies 36, 38 and, as such, is of sufficient strength to withstand the normal abuse of mailing. Also significant, when the mailing box 22 is in its folded flat configuration as respectively illustrated in side elevation in FIG. 4 and in plan in FIG. 7, it has a thickness 40 provided by a top ply and a bottom ply, namely an address panel 42 and side panel 44 constituting the top ply, and a rear panel 46 and opposite side panel 48 (see FIG. 5) constituting the bottom ply. In this condition, the flaps 30 are tucked between the top and bottom plies in out-of-the-way positions. It will be understood that the size of the unfolded mailing box 22 is selected to receive therein the gift-containing box 20, and this size relationship results, as best shown in FIG. 7, in a rectangular shape in the folded flat configuration of the mailing box 22 having dimensions 50 and 52 to receive in superposed relation the assemblage of the kit components of FIG. 3 preparatory to applying thereabout a clear plastic shrink wrap 24 to make available for sale the article of manufacture of FIG. 1. To facilitate mailing, panel 42 is provided with an allotted space 54 for the address of the addressee and space 56 for a return address.

While the article of manufacture herein shown and disclosed in detail is fully capable of attaining the objects and providing the advantages hereinbefore stated, it is to be understood that it is merely illustrative of the presently preferred embodiment of the invention, and that no limitations are intended to the detail of construction or design herein shown other than as defined in the appended claims.

What is claimed is:

1. As an article of manufacture, a kit for wrapping a product as a gift of a type including gift-wrapping components having a flat planar configuration characterized by four straight sides bounding a rectangular area of a selected size in a point-of-sales display in a compartment formed by an external wrap of clear plastic construction material, said gift wrapping components including a gift box collapsed into a flat planar configuration and foldable therefrom into a three dimensional configuration, the improvements to said kit comprising as an inclusion within said compartment a mailing box of cardboard construction material of a type foldable from a flat planar condition into a three dimensional configuration, said mailing box in said flat planar condition being similarly characterized by four straight sides bounding said same sized rectangular shape as said kit, whereby said mailing box effectively serves both as a flat support base in said kit during a covering relation thereover of said external wrap of clear plastic and upon removal of said plastic wrap as a usable three dimensional gift-wrapping component which encloses said gift box for mailing.

* * * * *